US006238273B1

(12) United States Patent
Southwick

(10) Patent No.: US 6,238,273 B1
(45) Date of Patent: May 29, 2001

(54) METHODS FOR PREDICTING POLISHING PARAMETERS OF POLISHING PADS AND METHODS AND MACHINES FOR PLANARIZING MICROELECTRONIC SUBSTRATE ASSEMBLIES IN MECHANICAL OR CHEMICAL-MECHANICAL PLANARIZATION

(75) Inventor: Scott A. Southwick, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/389,664

(22) Filed: Aug. 31, 1999

(51) Int. Cl.[7] ..... B24B 1/00

(52) U.S. Cl. ..... 451/41; 451/6; 451/8; 451/9; 451/59; 451/296; 451/303

(58) Field of Search ..... 451/41, 59, 6, 451/8, 9, 296, 303, 307

(56) References Cited

U.S. PATENT DOCUMENTS

| | | | | |
|---|---|---|---|---|
| 5,036,002 | * | 7/1991 | Sandhu et al. | 437/8 |
| 5,069,002 | * | 12/1991 | Sandhu et al. | 451/1 |
| 5,081,796 | * | 1/1992 | Schultz | 451/8 |
| 5,413,941 | * | 5/1995 | Koos et al. | 437/8 |
| 6,135,859 | * | 10/2000 | Tietz | 451/41 |

* cited by examiner

*Primary Examiner*—Joseph J. Hall, III
*Assistant Examiner*—Shantese McDonald
(74) *Attorney, Agent, or Firm*—Dorsey & Whitney LLP

(57) ABSTRACT

Methods for predicting polishing characteristics of polishing pads in mechanical or chemical-mechanical planarization of microelectronic substrate assemblies, and methods and machines for planarizing microelectronic substrate assemblies. One embodiment of a method in accordance with the invention includes ascertaining a surface parameter of a bearing surface of at least one raised feature projecting from a base portion of a raised feature polishing pad. The raised feature, for example, can be a pyramidal structure having a first cross-sectional area at the base portion of the pad and a second cross-sectional area at the bearing surface. The first cross-sectional area is generally greater than the second cross-sectional area. To ascertain the surface parameter of the bearing surface, one particular embodiment of the invention involves determining an indication of the surface area of the bearing surface. The surface area of the bearing surface can be estimated by illuminating the bearing surface with a light source and detecting an intensity of the light reflected from the bearing surface. The intensity of the reflected light is proportional to the surface area of the bearing surface, and thus the surface area of the bearing surface can be estimated by correlating the detected intensity of the reflected light with a predetermined relationship between the surface area and the light intensity. The actual surface area of selected bearing surfaces can also be measured by viewing the bearing surfaces through a confocal microscope or another type of optical device.

17 Claims, 6 Drawing Sheets

METHODS FOR PREDICTING POLISHING PARAMETERS OF POLISHING PADS AND METHODS AND MACHINES FOR PLANARIZING MICROELECTRONIC SUBSTRATE ASSEMBLIES IN MECHANICAL OR CHEMICAL-MECHANICAL PLANARIZATION

TECHNICAL FIELD

The present invention relates to mechanical or chemical-mechanical planarization of microelectronic substrate assemblies and, more particularly, to methods for predicting polishing characteristics of polishing pads used in such processes.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic substrate assemblies. CMP processes generally remove material from a substrate assembly to create a highly planar surface at a precise elevation in the layers of material on the substrate assembly.

FIG. 1 is a schematic isometric view of a web-format planarizing machine 10 that has a table 11 with a support surface 13. The support surface 13 is generally a rigid panel or plate attached to the table 11 to provide a flat, solid workstation for supporting a portion of a web-format planarizing pad 40 in a planarizing zone "A" during planarization. The planarizing machine 10 also has a pad advancing mechanism including a plurality of rollers to guide, position, and hold the web-format pad 40 over the support surface 13. The pad advancing mechanism generally includes a supply roller 20, first and second idler rollers 21*a* and 21*b*, first and second guide rollers 22*a* and 22*b*, and a take-up roller 23. As explained below, a motor (not shown) drives the take-up roller 23 to advance the pad 40 across the support surface 13 along a travel axis T—T. The motor can also drive the supply roller 20. The first idler roller 21*a* and the first guide roller 22*a* press an operative portion of the pad against the support surface 13 to hold the pad 40 stationary during operation.

The planarizing machine 10 also has a carrier assembly 30 to translate a microelectronic substrate assembly 12, such as a thin silicon semiconductor wafer, across the pad 40. In one embodiment, the carrier assembly 30 has a head 32 to pick up, hold and release the substrate assembly 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B to move the substrate assembly 12 across the pad 40.

The polishing pad 40 may be a non-abrasive polymeric web (e.g., a polyurethane sheet), or it may be a fixed abrasive polishing pad in which abrasive particles are fixedly dispersed in a resin or another type of suspension medium. The polishing pad 40 can have a planarizing surface 42 with a plurality of small raised features projecting from a base portion, or the pad 40 can have a relatively flat planarizing surface 42. FIG. 2A, for example, is an isometric view of a raised feature polishing pad in which the planarizing surface 42 has a plurality of raised features 43 projecting from a base portion of the pad 40. Each raised feature 43 has a small bearing surface 44 to contact the substrate assembly 12. FIG. 2B is an isometric view of a planar polishing pad in which the planarizing surface 42 has a large bearing surface 44 to contact the substrate assembly 12. The planar polishing pad shown in FIG. 2B can also have a plurality of grooves 45 to transport planarizing solution (not shown) under the substrate assembly 12. In either the raised feature pad or the planar pad shown in FIGS. 2A or 2B, abrasive particles may be fixedly attached to the pads such that the bearing surfaces 44 are abrasive.

Referring again to FIG. 1, a planarizing fluid 46 flows from a plurality of nozzles 47 during planarization of the substrate assembly 12. The planarizing fluid 46 may be a conventional CMP slurry with abrasive particles and chemicals that etch and/or oxidize the substrate assembly 12, or the planarizing fluid 46 may be a "clean" non-abrasive planarizing solution without abrasive particles. In most CMP applications, abrasive slurries are used on non-abrasive polishing pads, and clean solutions are used on fixed abrasive polishing pads.

In the operation of the planarizing machine 10, the pad 40 moves across the support surface 13 along the pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns to such small tolerances, however, is difficult when the planarized surfaces of substrate assemblies are not uniformly planar. Thus, to be effective, CMP processes should create highly uniform, planar surfaces on substrate assemblies.

In the highly competitive semiconductor industry, it is also desirable to maximize the throughput of CMP processing by producing a planar surface on a substrate assembly as quickly as possible. The throughput of CMP processing is a function of several factors, one of which is the ability to accurately stop CMP processing at a desired endpoint. In a typical CMP process, the desired endpoint is reached when the surface of the substrate assembly is planar and/or when enough material has been removed from the substrate assembly to form discrete components on the substrate assembly (e.g., shallow trench isolation areas, contacts, damascene lines, etc.). Accurately stopping CMP processing at a desired endpoint is important for maintaining a high throughput because the substrate assembly may need to be re-polished if it is "under-planarized." Accurately stopping CMP processing at the desired endpoint is also important because too much material can be removed from the substrate assembly, and thus it may be "over-polished." For example, over-polishing can cause "dishing" in shallow-trench isolation structures or completely destroy a section of the substrate assembly. Thus, it is highly desirable to stop CMP processing at the desired endpoint.

Raised feature polishing pads, like the one shown in FIG. 2A, are relatively new and have the potential to produce highly planar surfaces because the small spaces between the raised features 43 hold a portion of the planarizing solution on the pad 40 to provide a relatively uniform distribution of planarizing solution under the substrate assembly 12 during planarization. The raised feature polishing pads, however, may have relatively short life cycles and they may produce unpredictable results. For example, the small raised features 43 shown in FIG. 2A generally wear down much faster than the large bearing surface 44 of the planar pad shown in FIG. 2B. The faster wear rate of the raised features 43 reduces the life cycle of raised feature pads. Moreover, any discrepancies of downforce, residence time or other planarizing parameters can produce substantially difference wear levels across a raised feature polishing pad over a number of planarizing cycles. The different wear levels of the raised features will generally result in significantly different polishing rates either across the pad or from one planarizing cycle to another. Such changes in the polishing rate may make it difficult to predict the endpoint of planarizing cycles and/or produce planar surfaces on the finished substrate assemblies. Thus, raised feature polishing pads may produce unpredictable results.

SUMMARY OF THE INVENTION

The present invention is directed toward methods for predicting polishing characteristics of polishing pads in mechanical and/or chemical-mechanical planarization processes, and to methods and machines for planarizing semiconductor wafers and other microelectronic substrate assemblies. One aspect of a method in accordance with the invention includes ascertaining a surface parameter of a bearing surface of at least one raised feature projecting from a base portion of a raised feature polishing pad. The raised feature, for example, can be a pyramidal structure having a first cross-sectional area at the base portion of the pad and a second cross-sectional area at the bearing surface. The first cross-sectional area is generally greater than the second cross-sectional area. To ascertain the surface parameter of the bearing surface, an indication of the surface area of the bearing surface may be determined. The surface area of the bearing surface can be estimated by illuminating the bearing surface with a light source and detecting an intensity of the light reflected from the bearing surface. The intensity of the reflected light is generally proportional to the surface area of the bearing surface, and thus the surface area of the bearing surface can be estimated by correlating the detected intensity of the reflected light with a predetermined relationship between the surface area and the light intensity. The actual surface area of selected bearing surfaces can also be measured by viewing the bearing surfaces through a confocal microscope or another type of optical device, or using some other means.

Several polishing characteristics of raised feature polishing pads can be predicted using either an estimated or an actual measurement of the surface area of the bearing surfaces. One aspect of the present invention is the discovery that the surface area of the bearing surfaces is generally proportionate to the polishing rate for the polishing pad. As such, the polishing rate of a polishing pad, or even the polishing rate of a particular region on the polishing pad, can be predicted by measuring the surface area of the bearing surfaces. The estimated polishing rate can then be used to determine whether the pad is suitable for a particular application, or the estimated polishing rate can be used to adjust the time of the planarizing cycle for more accurate endpointing of CMP processing. Therefore, determining the size or surface area of the bearing surfaces is expected to enhance the consistency and predictability of planarizing substrate assemblies using raised feature polishing pads.

DETAILED DESCRIPTION OF THE INVENTION

The present invention relates to methods for predicting polishing characteristics of raised feature polishing pads used in mechanical or chemical-mechanical planarizing processes, and to methods for planarizing semiconductor wafers and other microelectronic substrate assemblies. Many specific details of the invention are described below with reference to raised feature polishing pads having pyramidal raised features to provide a thorough understanding of such embodiments. The present invention, however, may be practiced on polishing pads having other raised feature structures, such as using mounds (e.g., Kapton Textured Polymide Pads) or irregular nodules (e.g., random patterned nodule pads as set forth in U.S. application Ser. No. 09/001,333, which is herein incorporated by reference). Thus, one skilled in the art will understand that the present invention may have additional embodiments, or that the invention may be practiced without several of the details described in the following description.

Figure 3:
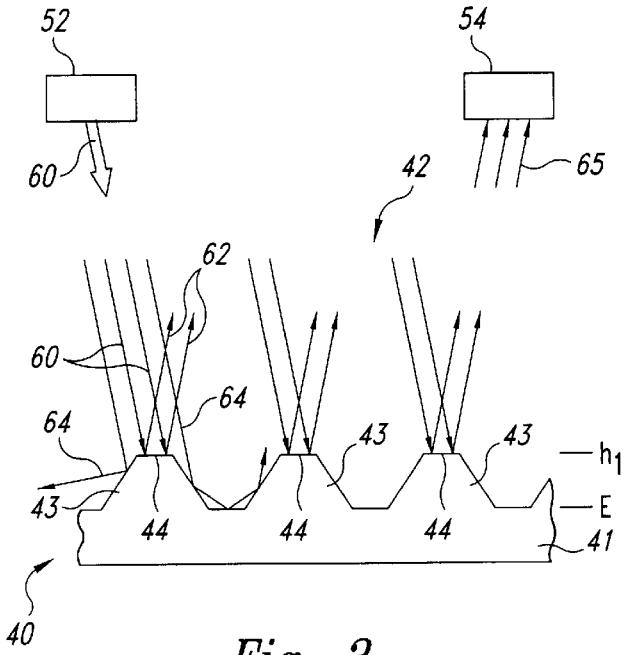
FIG. 3 is a partial cross-sectional view of a raised feature polishing pad at one stage of being analyzed in accordance with an embodiment of a method in accordance with the invention.
Figure 4:
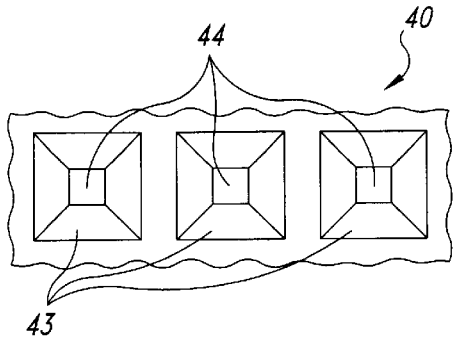
FIG. 4 is a top plan view of the raised feature polishing pad of FIG. 3.
Figure 5:
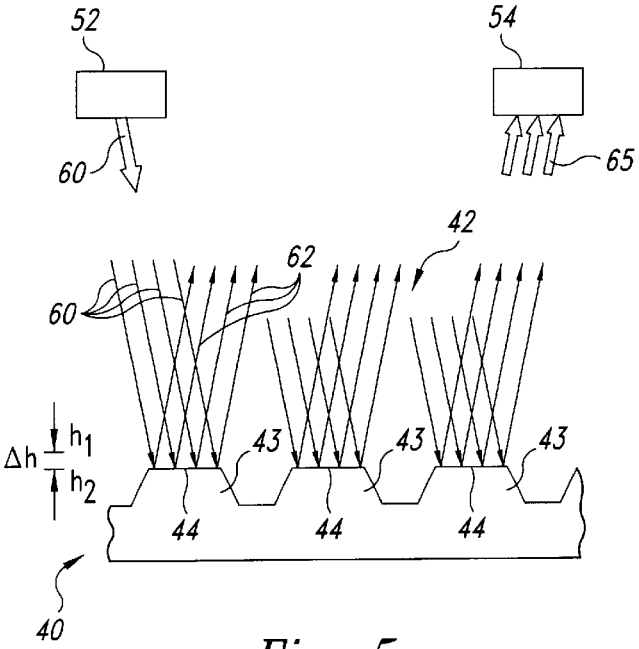
FIG. 5 is a partial cross-sectional view of the raised feature polishing pad of FIG. 3 at another stage of being analyzed in accordance with an embodiment of the method shown in FIG. 3.
Figure 6:
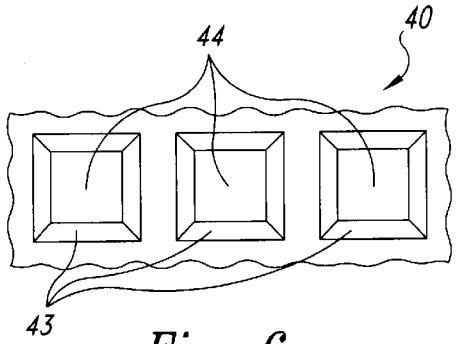
FIG. 6 is a top plan view of the polishing pad of FIG. 5.

FIGS. 3–6 illustrate a portion of a raised feature polishing pad 40 being analyzed at different stages of a method for predicting a polishing characteristic of the polishing pad 40 in accordance with one embodiment of the invention. FIGS. 3 and 4 show the polishing pad 40 at a relatively early stage in its life. The pad 40 has a planarizing surface 42 with a plurality of pyramidal raised features 43 projecting upwardly from a base section 41 of the polishing pad 40. The pyramidal features 43 each have a bearing surface 44 at a height $h_1$ above a base elevation E at this early stage in the life of the pad 40. For example, the height $h_1$ can be approximately 10–1000 $\mu$m and the surface area of the bearing surfaces 44 can be approximately 10%–30% of the total surface area of the planarizing surface 42. FIGS. 5 and 6 illustrate the pad 40 at a later stage in its life after planarizing one or more microelectronic substrate assemblies on the bearing surfaces 44. The abrasive contact between the substrate assemblies and the bearing surfaces 44 wears the raised features 43, causing a change in height Ah of the bearing surfaces 44 from $h_1$ to $h_2$. Referring to FIGS. 4 and 6 together, the change in height of the bearing surfaces 44 causes an increase in the surface of the bearing surfaces 44 because the sidewalls of the pyramidal raised features 43 are inclined at an angle. As explained in more detail below, several polishing characteristics, such as the polishing rate and the quality of the pad, can be predicted from the change in surface area of the bearing surfaces 44.

FIGS. 3 and 5, more particularly, illustrate one embodiment of a method for predicting polishing characteristics of the polishing pad 40 by estimating the surface area of one or more of the bearing surfaces 44. Referring to FIG. 3, a light source 52 illuminates a region of the polishing pad 40 with a light beam 60. An unscattered portion 62 of the light beam 60 reflects off of the bearing surfaces 44, and a scattered portion 64 reflects off of other surfaces of the raised features 43 and the polishing pad 40. A light sensor 54 detects the intensity of a return light 65 reflected from the bearing surfaces 44 and the other surfaces of the pad 40. Comparing FIG. 3 to FIG. 5, as the surface area of the bearing surfaces 44 increases, the unscattered portion 62 of the light beam 60 increases and the scattered portion 64 decreases. The light sensor 54 accordingly detects an increase in the intensity of the return light 65 as the surface area of the bearing surfaces 44 increases.

In one particular embodiment of a method in accordance with the invention, a relationship between the surface area of the bearing surfaces 44 and the reflected light 65 is determined empirically by periodically measuring the intensity of the reflected light 65 as the surface area of the bearing surfaces 44 increases, and then measuring the actual size of the bearing surfaces 44 for each light intensity measurement. A correlation between the surface area of the bearing surfaces and the reflected light intensity can then be established. In one embodiment, such a correlation is established when the planarizing surface 42 is not covered by a planarizing fluid by measuring the intensity of the reflected light 65 and then measuring the actual surface area of the bearing surfaces 44 using a microscope. In another embodiment, this correlation is established when a clear planarizing fluid covers the planarizing surface 42 by measuring the intensity of the reflected light 65 while the clear planarizing fluid is on the planarizing surface 42, removing the clear planarizing solution from the planarizing surface 42, and then measuring the actual surface area of the bearing surfaces 44 using a microscope. The planarizing fluid is removed from the pad before measuring the surface area of the bearing surfaces 44 to avoid optical distortions or other errors that the clear planarizing fluid may produce in measurements taken with a microscope. Based upon the correlation between the intensity of the reflected light and the surface area of the bearing surfaces 44 when the clear planarizing solution covers the planarizing surface area of the bearing surfaces 44 can thus be estimated by sensing the reflected light either during or between planarizing cycles.

The data of the surface area of the bearing surfaces 44 can be used to determine or predict the polishing rate of the raised feature polishing pad 40. One particular method of the invention accordingly determines the correlation between the surface area of the bearing surfaces 44 and the polishing rate of the polishing pad 40 by measuring the actual surface area of the bearing surface 44 and the actual polishing rate of several microelectronic device substrate assemblies. It has been discovered that there is generally a linear correlation between the surface area of the bearing surfaces 44 and the polishing rate of the polishing pad 40. The polishing rates of various regions of a raised feature polishing pad can accordingly be determined by detecting the intensity of the reflected light from the bearing surfaces 44 at several different regions across the polishing pad 40.

The data of the surface area of the bearing surfaces 44 can also be used to test the quality or status of the raised feature of polishing pad 40. For example, when a new polishing pad is attached to the planarizing machine or a new portion of a web-format pad is introduced into the planarizing zone, the surface area of the bearing surfaces 44 will generally indicate whether the planarizing surface 42 will produce acceptable planarizing results. In the case of a new pad, the planarizing surface may be defective when the surface area measurements are outside of a predetermined range. Similarly, surface area measurements of a region of the polishing pad in the planarizing zone outside of a predetermined range may indicate premature wearing of the pad or other defects.

The methods described above with reference to FIGS. 3–6 are expected to enhance the uniformity of substrate assemblies planarized on raised feature polishing pads. For example, by predicting the polishing rates of several different regions across the polishing pad 40, a polishing pad with large variances in the polishing rates can be replaced with a pad in which the surface area of the bearing surfaces 44 are more uniform. The more uniform surface area of the bearing surfaces 44 should provide more uniform polishing rates across the pad 40 and result in a more uniform planar surface.

The methods described above with reference to FIGS. 3–6 are also expected to enhance the accuracy of endpointing planarizing cycles on raised feature polishing pads. For example, by predicting the polishing rate of the pads either during or before planarizing a substrate assembly, the polishing time can be adjusted to compensate for changes in the polishing rate. With reference to FIGS. 3 and 5, the increase in surface area of the bearing surfaces 44 will produce a higher polishing rate, and thus the planarizing time can be reduced when using the pad 40 at the stage shown in FIG. 5. Determining the surface area of the bearing surfaces 44, therefore, is expected to enhance the accuracy of endpointing CMP processing to avoid overpolishing or underpolishing of the substrate assemblies.

The methods described above with reference to FIGS. 3–5 are further expected to prolong the lifecycle of raised feature polishing pads to reduce the consumption of polishing pads. In conventional CMP processes using raised feature pads without estimating the surface area of the bearing surfaces 44, many such pads were considered worn out after only approximately 10% of the height of the raised features 43 had worn away because these pads often caused overpolishing of the substrate assemblies. The methods described above, however, avoid overpolishing by predicting the polishing rate of raised feature pads according to the surface area of the bearing surfaces 44 and adjusting the polishing time to remove the desired amount of material from the substrate assemblies. Therefore, it is expected that several embodiments of the methods described above can be used to prolong the pad life because accurately adjusting the polishing time will allow for more removal of material from the raised features before the polishing pad is too worn to accurately planarize the substrate assemblies.

Figure 1:
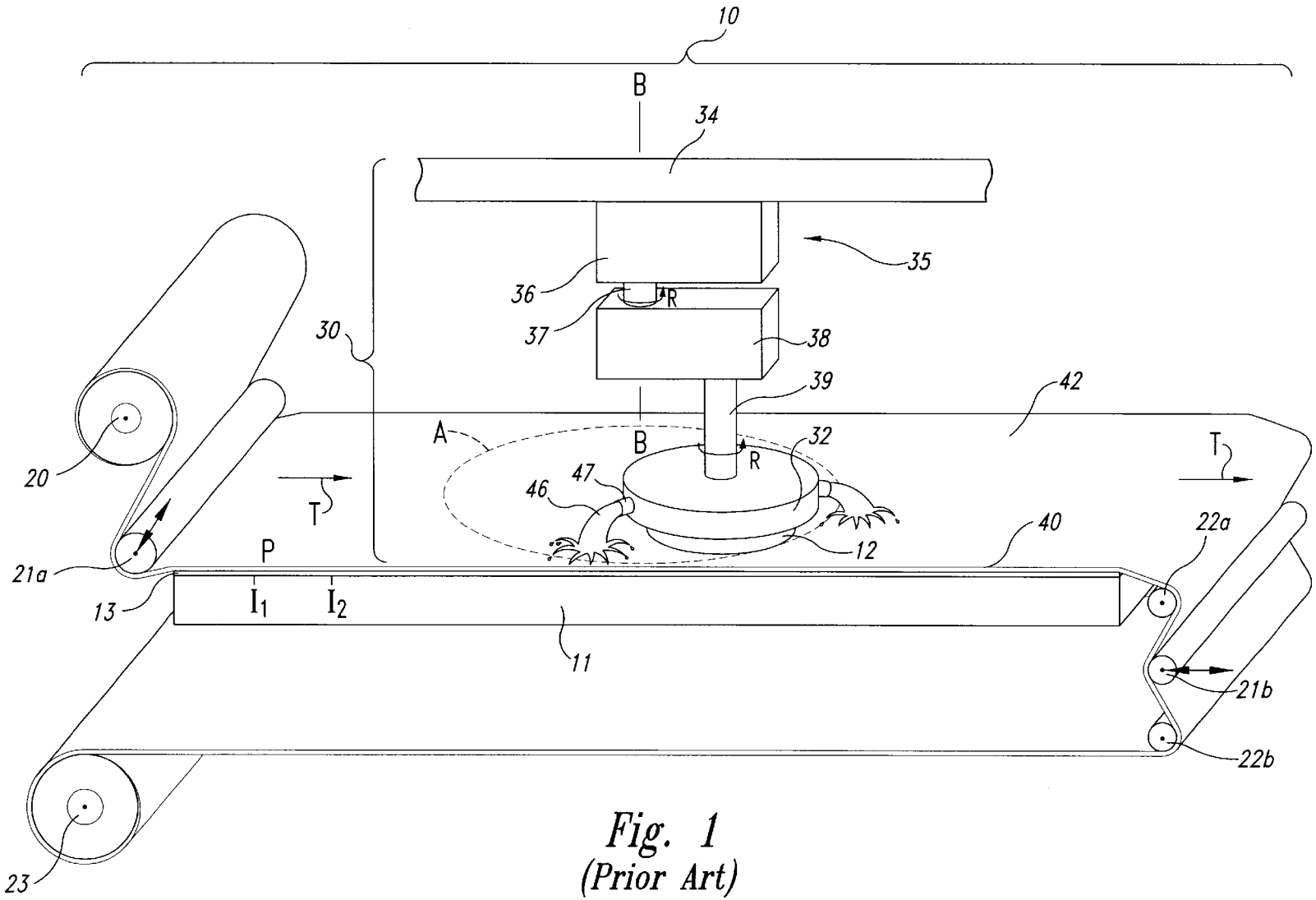
Fig. 1 (Prior Art)
FIG. 1 is an isometric view of a web-format planarizing machine in accordance with the prior art.
Figure 2A:
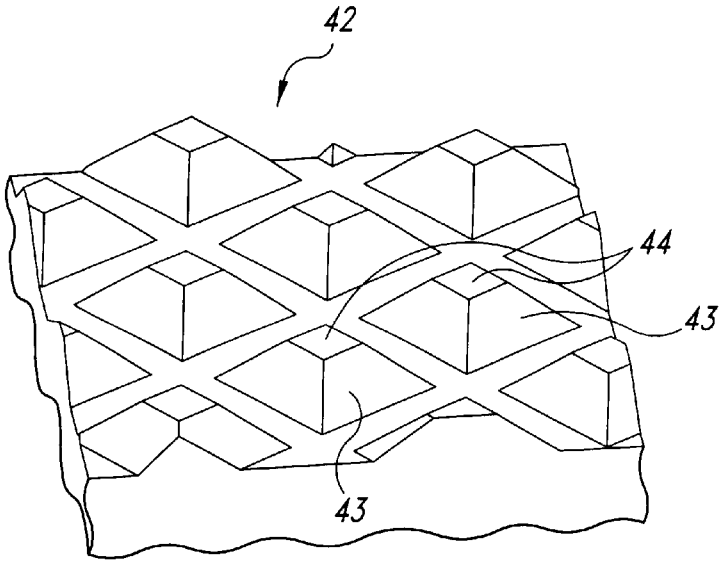
FIG. 2A is an isometric view of a raised-feature polishing pad.
Figure 2B:
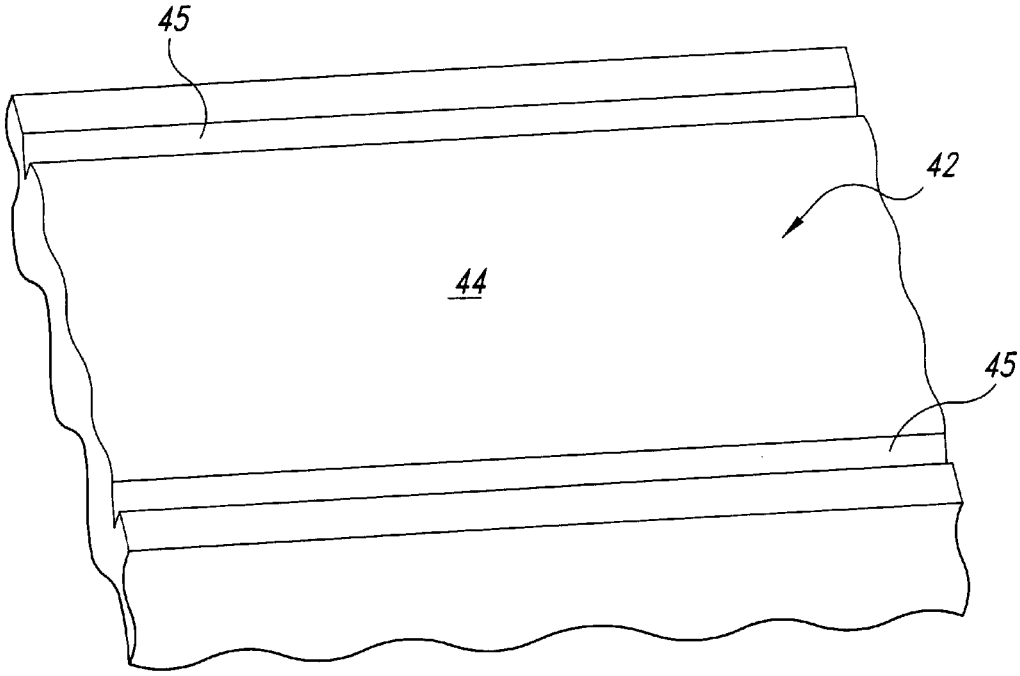
FIG. 2B is an isometric view of a planar polishing pad.
Figure 7:
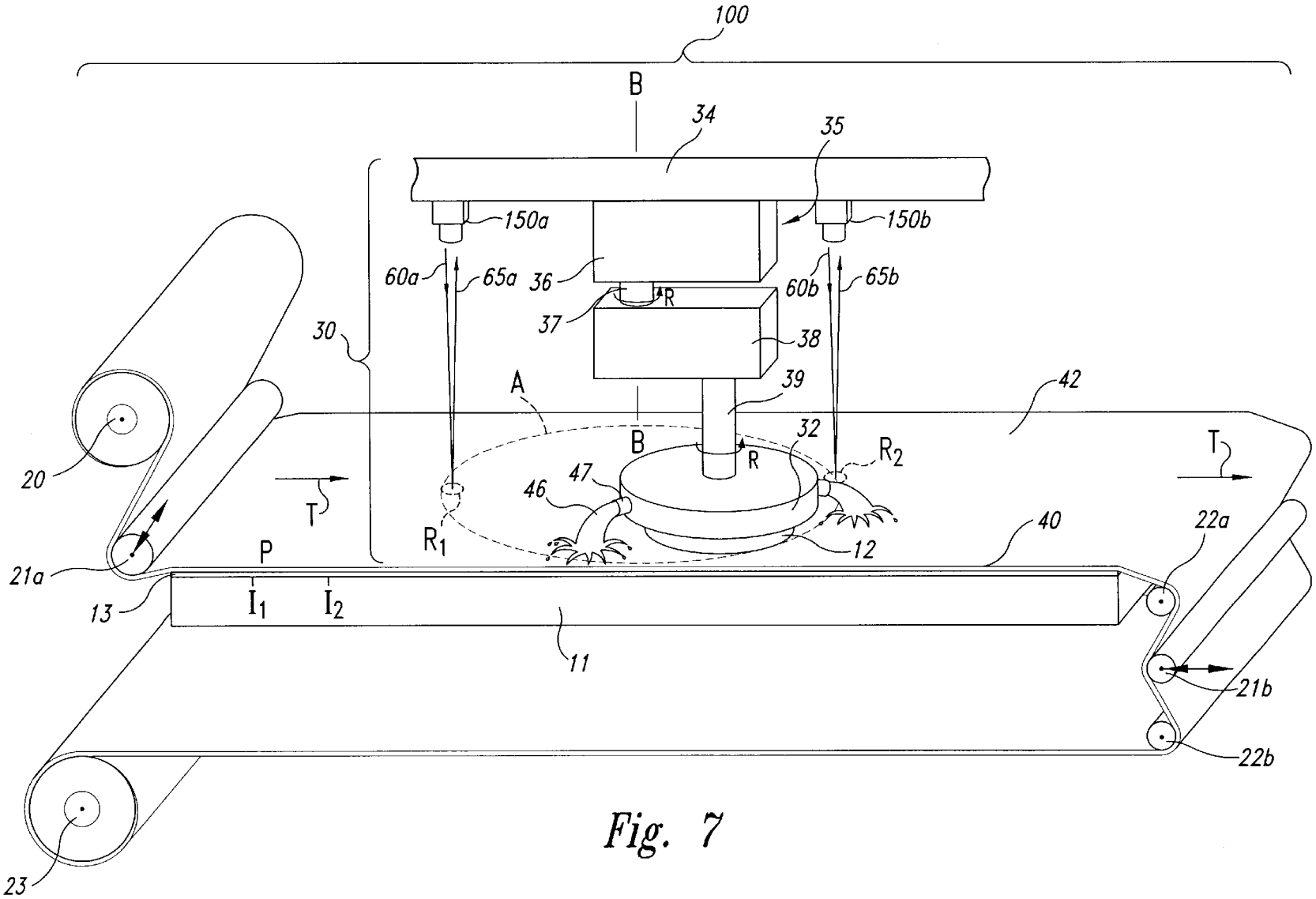
FIG. 7 is an isometric view of a web-format planarizing machine in accordance with an embodiment of the invention.

FIG. 7 is an isometric view of a planarizing machine in accordance with one embodiment of the invention for practicing the methods described above with reference to FIGS. 3–6. The planarizing machine 100 is similar to the planarizing machine 10 described above in FIG. 1, and like reference numbers refer to like parts. The planarizing machine 100 further includes a first optical sensor 150*a* positioned over a first region $R_1$ of the planarizing zone A and a second optical sensor 150*b* positioned over a second region $R_2$ of the planarizing zone A. In this embodiment, the first and second optical sensors 150*a* and 150*b* are illuminating devices that each have a light source that projects a light beam 60 (identified by reference numbers 60*a* and 60*b*) and a light sensor that detects a return light 65 (identified by reference numbers 65*a* and 65*b*). The optical sensors 150*a* and 150*b*, for example, can be lasers or other types of light sources. The optical sensors 150*a* and 150*b* estimate the surface area of the bearing surfaces on the polishing pad 40 in the manner described above with reference to FIGS. 3–6. The first optical sensor 150*a*, more particularly, estimates the surface area of the bearing surfaces of the polishing pad 40 at one side of the planarizing zone A when a fresh portion of the polishing pad 40 enters the planarizing zone A as the pad 40 moves along a travel path T—T. The second optical sensor 150*b* estimates the surface area of the bearing surfaces at an opposite side of the planarizing zone A to determine whether the polishing pad 40 should be incrementally advanced along the travel path T—T to remove a worn portion of the pad from the planarizing zone A.

Figure 8:
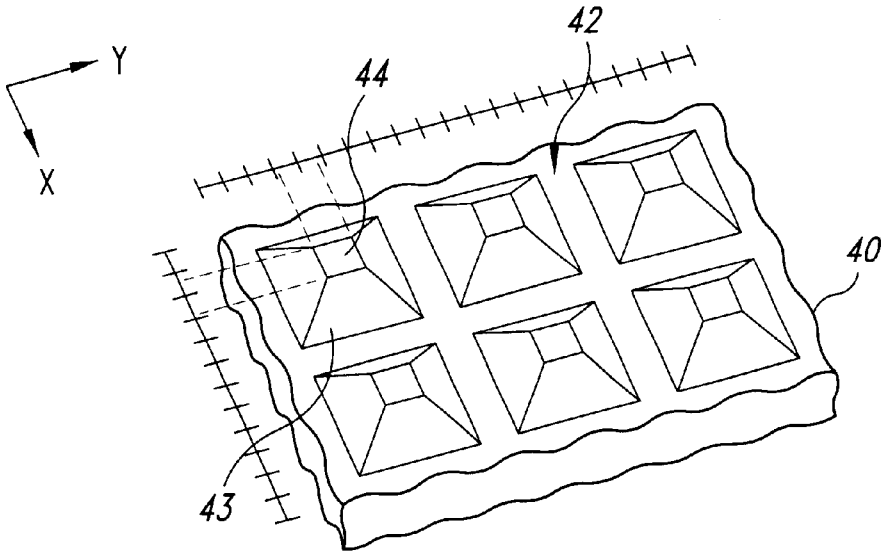
FIG. 8 is a partial isometric view of a polishing pad at one stage of being analyzed in accordance with another method in accordance with another embodiment of the invention.
Figure 9:
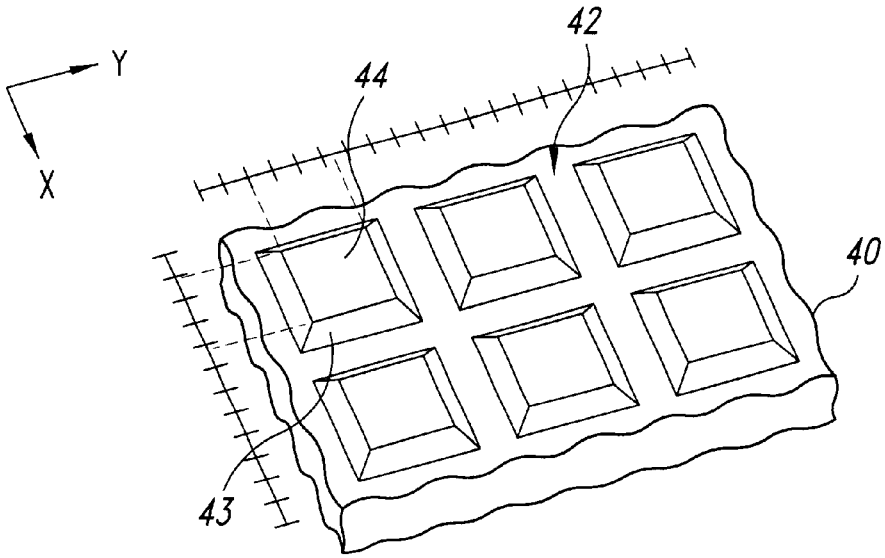
FIG. 9 is a partial isometric view of the polishing pad of FIG. 8 at a different stage of being analyzed in accordance with the method shown in FIG. 8.

FIGS. 8 and 9 are partial isometric views of the raised feature polishing pad 40 illustrating a different method for predicting a polishing characteristic of the polishing pad 40. Referring to FIG. 8, the actual surface area of a bearing surface 44 is measured using a confocal microscope or another suitable optical measuring device. One suitable confocal microscope for practicing this embodiment of the invention is manufactured by Lasertec Company. To measure the actual size of the bearing surface 44, the planarizing surface 42 is scanned with the microscope, and then a scale is superimposed on the X and Y axes to determine the dimensions of the bearing surface 44. The pad 40 is typically scanned without a planarizing solution on the planarizing surface 42. FIGS. 8 and 9, therefore, illustrate measuring the actual surface area of the bearing surface 44 to predict the polishing rate and other characteristics of the polishing pad 40, as set forth above with respect to FIGS. 3–6.

Figure 10:
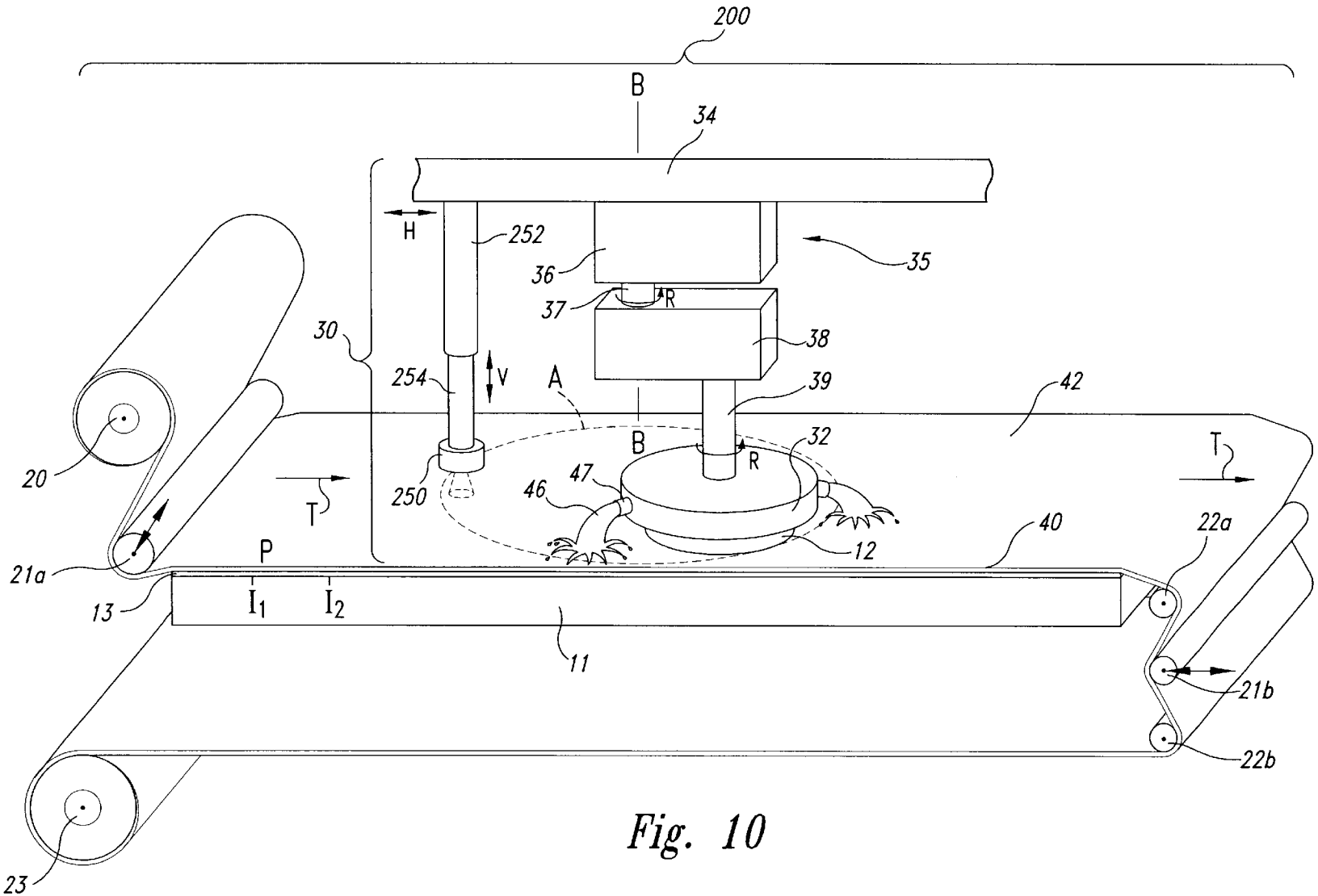
FIG. 10 is an isometric view of a web-format planarizing machine in accordance with another embodiment of the invention.

FIG. 10 is an isometric view of another planarizing machine 200 in accordance with an embodiment of the invention. In this embodiment, the planarizing machine 200 has an optical sensor 250 attached to a holder 252. In one embodiment, the optical sensor 250 is a microscope, a confocal microscope, or another suitable optical measuring device. Additionally, the holder 252 can move along the gantry 34 (arrow H), or the holder 252 can have a retractable rod 254 that moves vertically (arrow V) with respect to the pad 40. In operation, the holder 252 moves horizontally along the gantry 34 and/or retracts the rod 254 vertically to move the optical sensor 250 out of the way of the head 32 during a planarizing cycle. After a substrate assembly 12 has been planarized, the holder 252 then positions the optical sensor 250 over a desired region of the planarizing zone A to measure the surface area of the bearing surfaces in that region. The holder 252 can accordingly move the optical sensor 250 over various regions of the pad 40 to measure the surface area of the bearing surfaces at a plurality of different regions across the planarizing zone A.

From the foregoing it will be appreciated that, although specific embodiments of the invention have been described herein for purposes of illustration, various modifications may be made without deviating from the spirit and scope of the invention. For example, other characteristics of surface features of the bearing surfaces, such as the topography of the bearing surfaces, the outline or shape of the bearing surfaces and/or a change in height of the raised features, can be ascertained with a confocal microscope, an interferometer, or other types of optical viewing or non-optical measuring devices. Accordingly, the invention is not limited except as by the appended claims.

What is claimed is:

1. In mechanical or chemical-mechanical planarization of microelectronic substrate assemblies, a method of predicting polishing characteristics of a raised feature polishing pad comprising ascertaining a surface parameter of a bearing surface of at least one raised feature projecting from a base portion of the raised feature polishing pad.

2. The method of claim 1 wherein:

the raised feature comprises a pyramidal structure having a first cross-sectional area at the base portion of the pad and a second cross-sectional area at the bearing surface, the first cross-sectional area being greater than the second cross-sectional area; and ascertaining the surface parameter of the bearing surface comprises determining an indication of a surface area of the bearing surface by illuminating the bearing surface with a light source and detecting an intensity of light reflected from the bearing surface, the greater the intensity of the reflected light indicating the greater the surface area of the bearing surface.

3. The method of claim 1 wherein:

the raised feature comprises a pyramidal structure having a first cross-sectional area at the base portion of the pad and a second cross-sectional area at the bearing surface, the first cross-sectional area being greater than the second cross-sectional area;

ascertaining the surface parameter of the bearing surface comprises determining a surface area of the bearing surface by measuring first and second dimensions of the bearing surface with a microscope; and the method further comprises correlating the determined surface area of the bearing surface with a predetermined relationship between bearing surface size and polishing rate to estimate a polishing rate of a region of the polishing pad including the bearing surface.

4. The method of claim 1 wherein:

the raised feature comprises a pyramidal structure having a first cross-sectional area at the base portion of the pad and a second cross-sectional area at the bearing surface, the first cross-sectional area being greater than the second cross-sectional area; and ascertaining the surface parameter of the bearing surface comprises determining an actual surface area of the bearing surface.

5. The method of claim 1 wherein:

the raised feature comprises a structure having a first cross-sectional area at the base portion of the pad and a second cross-sectional area at the bearing surface; and ascertaining the surface parameter of the bearing surface comprises determining an indication of a surface area of the bearing surface.

6. The method of claim 1 wherein:

the raised feature comprises a post projecting from the base portion of the pad, the post having at least a substantially constant cross-sectional dimension; and ascertaining the surface parameter of the bearing surface comprises determining a topography of the bearing surface.

7. The method of claim 1 wherein ascertaining the surface parameter of the bearing surface comprises determining a change in outline of the bearing surface.

8. The method of claim 1 wherein ascertaining the surface parameter of the bearing surface of at least one raised feature comprises estimating the surface area of a plurality of bearing surfaces of a plurality of raised features located in different regions across the polishing pad.

9. The method of claim 1 wherein:

the polishing pad is a web-format pad configured to be advanced across a stationary table to replace a worn portion of the pad at one side of a planarizing zone with a fresh portion of the pad at an opposite side of the planarizing zone, and each raised feature comprises a pyramidal structure having a bottom section at the base portion of the pad and a separate bearing surface smaller than the bottom section;

ascertaining the surface parameter of the bearing surface comprises determining the surface area of a bearing surface of at least one selected raised feature located at the worn side of the planarizing zone; and advancing the polishing pad to remove the selected raised feature from the planarizing zone.

10. In mechanical or chemical-mechanical planarization of microelectronic substrate assemblies, a method of predicting polishing characteristics of polishing pads having a plurality of bearing surfaces to contact the substrate assemblies, each bearing surface being at an upper terminus of a raised feature projecting from a base portion of the pad, the method comprising monitoring an outline of a bearing surface of at least one raised feature.

11. The method of claim 10 wherein:

the raised feature comprises a pyramidal structure having a first cross-sectional area at the base portion of the pad and a second cross-sectional area at the bearing surface, the first cross-sectional area being greater than the second cross-sectional area; and monitoring the outline of the bearing surface comprises determining a change in a surface area of the bearing surface by illuminating the bearing surface with a light source and detecting an intensity of light reflected from the bearing surface, the greater the intensity of the reflected light indicating the greater the surface area of the bearing surface.

12. The method of claim 10 wherein:

the raised feature comprises a pyramidal structure having a first cross-sectional area at the base portion of the pad and a second cross-sectional area at the bearing surface, the first cross-sectional area being greater than the second cross-sectional area;

monitoring the outline of the bearing surface comprises determining a surface area of the bearing surface by measuring first and second dimensions of the bearing surface with a microscope; and the method further comprises correlating the determined surface area of the bearing surface with a predetermined relationship between bearing surface size and polishing rate to estimate a polishing rate of a region of the polishing pad including the bearing surface.

13. The method of claim 10 wherein:

the raised feature comprises a pyramidal structure having a first cross-sectional area at the base portion of the pad and a second cross-sectional area at the bearing surface, the first cross-sectional area being greater than the second cross-sectional area; and monitoring the outline of the bearing surface comprises determining an actual surface area of the bearing surface.

14. The method of claim 10 wherein:

the polishing pad is a web-format pad configured to be advanced across a stationary table to replace a worn portion of the pad at one side of a planarizing zone with a fresh portion of the pad at an opposite side of the planarizing zone, and each raised feature comprises a pyramidal structure having a bottom section at the base portion of the pad and a separate bearing surface smaller than the bottom section;

monitoring an outline of the bearing surface comprises determining the surface area of a bearing surface of at least one selected raised feature located at the worn side of the planarizing zone; and advancing the polishing pad to remove the selected raised feature from the planarizing zone.

15. In mechanical or chemical-mechanical planarization of microelectronic substrate assemblies, a method of predicting polishing characteristics of polishing pads including a plurality of raised features having bearing surfaces to contact the substrate assemblies, the method comprising determining a change in height of a selected bearing surface relative to a base elevation below the bearing surface.

16. In mechanical or chemical-mechanical planarization of microelectronic substrate assemblies, a method of predicting a wear level of a polishing pad having a plurality of bearing surfaces to contact the substrate assemblies, each bearing surface being at an upper terminus of a raised feature projecting from a base portion of the pad, the method comprising:

determining a mathematical relationship between a surface area of the bearing surfaces and the polishing rate of the polishing pad;

ascertaining an indication of a surface area of the bearing surface; and estimating a polishing rate by correlating the ascertained surface area of the bearing surface with the relationship between the surface area of the bearing surface and the polishing rate of the polishing pad.

17. In mechanical or chemical-mechanical planarization of microelectronic substrate assemblies, a method of predicting a wear level of a polishing pad having a plurality of bearing surfaces to contact the substrate assemblies, each bearing surface being at an upper terminus of a raised feature projecting from a base portion of the pad, the method comprising:

determining a maximum surface area of the bearing surfaces at which the polishing rate provides acceptable planarizing results;

ascertaining an indication of a surface area of the bearing surface; and comparing the ascertained surface area with a desired surface area range to estimate whether the pad is within a useful wear level.

* * * * *